US010082278B2

(12) United States Patent
Ladstätter

(10) Patent No.: US 10,082,278 B2
(45) Date of Patent: Sep. 25, 2018

(54) ARRANGEMENT FOR FORMING AN ELONGATE, CHANNEL-TYPE ACCOMMODATION SPACE

(71) Applicant: ZUMTOBEL LIGHTING GMBH, Dornbirn (AT)

(72) Inventor: Gerald Ladstätter, Klaus (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 71 days.

(21) Appl. No.: 15/128,305

(22) PCT Filed: Apr. 27, 2015

(86) PCT No.: PCT/EP2015/059084
§ 371 (c)(1),
(2) Date: Sep. 22, 2016

(87) PCT Pub. No.: WO2015/165852
PCT Pub. Date: Nov. 5, 2015

(65) Prior Publication Data

US 2017/0102133 A1 Apr. 13, 2017

(30) Foreign Application Priority Data

Apr. 28, 2014 (DE) ..... 20 2014 101 985 U

(51) Int. Cl.
*F21S 4/00* (2016.01)
*F21V 21/02* (2006.01)
*F21V 31/00* (2006.01)

(52) U.S. Cl.
CPC ..... *F21V 21/025* (2013.01); *F21V 31/00* (2013.01)

(58) Field of Classification Search
CPC ..... F21V 21/025; F21V 21/005
See application file for complete search history.

(56) References Cited

U.S. PATENT DOCUMENTS 5,499,170 A 3/1996 Gagne
2003/0103347 A1 6/2003 Friend
(Continued)

FOREIGN PATENT DOCUMENTS

DE 4406364 8/1995
DE 102009013749 11/2009
(Continued)

OTHER PUBLICATIONS

German search report Application 20 2014 101 985.5 dated Dec. 6, 2014.

(Continued)

*Primary Examiner* — Sean Gramling
(74) *Attorney, Agent, or Firm* — Andrus Intellectual Property Law

(57) ABSTRACT

An arrangement for forming an elongate, channel-type accommodation space comprises at least two elongate mounting rail elements, two of the mounting rail elements being arranged so that their front faces abut via a joint. The arrangement further comprises a first shaped part and a second shaped part connected to the first profiled part to form the channel-type accommodation space, said space at least substantially extending at least over the length of the two mounting rail elements, and one of the two shaped parts being fastened to the mounting rail elements.

18 Claims, 2 Drawing Sheets

(56) References Cited

U.S. PATENT DOCUMENTS

| | | | | |
|---|---|---|---|---|
| 2006/0028813 | A1 | 2/2006 | Hwang et al. | |
| 2010/0214770 | A1 | 8/2010 | Anderson | |
| 2010/0238655 | A1 | 9/2010 | Sloan et al. | |
| 2010/0309658 | A1 | 12/2010 | Rouse et al. | |
| 2014/0268748 | A1* | 9/2014 | Lay | F21V 15/01 362/235 |

FOREIGN PATENT DOCUMENTS

| | | |
|---|---|---|
| DE | 102010018018 | 11/2010 |
| DE | 202012102874 | 6/2013 |
| DE | 202012101239 | 8/2013 |
| DE | 102013205934 | 10/2013 |
| EP | 1612901 | 1/2006 |
| EP | 2243998 | 10/2010 |
| GB | 2459942 | 11/2009 |
| WO | 9906759 | 2/1999 |

OTHER PUBLICATIONS

Austria search report Application GM 222/2014 dated Dec. 12, 2014.

International Search Report PCT/EP2015/059084 dated Jun. 24, 2015.

* cited by examiner

ARRANGEMENT FOR FORMING AN ELONGATE, CHANNEL-TYPE ACCOMMODATION SPACE

CROSS REFERENCE TO RELATED APPLICATIONS

The present application is the U.S. national stage application of International Application PCT/EP2015/059084, filed Apr. 27, 2015, which international application was published on Nov. 5, 2015 as International Publication WO 2015/165852 A1. The International Application claims priority to German Patent Application 20 2014 101 985.5 filed Apr. 28, 2014.

FIELD OF THE INVENTION

The invention pertains to an arrangement for forming an elongate, channel-type accommodation space.

BACKGROUND

Such an arrangement is known from the state of the art in the form of a continuous row lighting system, in which several U-shaped mounting rail elements are arranged in a row, abut at front, to form an elongate accommodation spaceabut. The accommodation space can thereby extend for many meters. The mounting rail elements can then be equipped with many different lighting or optical inserts; the attaching of these inserts is thereby typically done by an end customer, respectively the user of the row lighting system. The user thereby quasi builds the desired end product from a multitude of components.

One problem, however, is that the formed elongated channel-type accommodation space does not provide suitable or reliable protection from dust or moisture. The row lighting system is therefore hardly suitable for an application in industrial rooms, in which a respectively higher protection is desired.

SUMMARY OF THE INVENTION

It is the task of the invention to specify an improved arrangement for the forming of an elongate, channel-type accommodation space. The arrangement shall particularly also be suitable for a row lighting system with a higher protection from dust, respectively moisture.

According to the invention, this task is solved with the subject matter described hereafter.

According to the invention, an arrangement is intended for forming an elongate, channel-type accommodation space that comprises at least two elongate mounting rail elements, whereby two of the mounting rail elements are arranged so that their front faces abut via a joint. The arrangement further comprises a first shaped part and a second shaped part connected to the first shaped part to form the channel-type accommodation space, said space at least substantially extending at least over the length of the two mounting rail elements. One of the two shaped parts is thereby fastened to the mounting rail elements.

Through the two shaped parts connected with each other, the accommodation space can preferably be designed dense, and namely throughout its entire length. A forming of joints can be prevented this way, in particular. The mounting rail elements can be "lined" using the shaped parts, so to speak.

The first shaped part and the second shaped part are preferably joined together. A particularly suitable tightness can be achieved through a form closure.

The first shaped part and or the second shaped part are preferably formed from an elastic material at least in part, especially from a material that is more elastic than the mounting rail elements. The accommodation space can hereby be designed suitably tight and can thereby—through the mounting rail elements—still achieve a suitable stability and sustainability.

The first shaped part and or the second shaped part are preferably designed so that they can be wound up to a roll. The shaped parts—even if they are of very great lengths, are therefore many meters long, for example—are hereby especially suitable for transport. An especially simple transport to a respective operation site is hereby enabled, in particular.

The first shaped part is preferably arranged in direct contact with the two mounting rail elements. It is thus achieved, in particular, that the first shaped part is supported directly and thus especially suitable by the mounting rail elements. One can thereby achieve an especially suitable support, if the first shaped part is arranged flat adjacent to the two mounting rail elements.

The second shaped part is preferably arranged held onto the first shaped part by means of a clamp connection, especially merely through the clamp connection. An especially simple assembly of the two shaped parts is hereby enabled with a suitable tightness of the accommodation space.

The first shaped part is preferably arranged on the two mounting rail elements through a form-locking connection, preferably held through a lock-in connection. This enables a particularly simple fastening of the first shaped part to the mounting rail elements.

The mounting rail elements preferably have an essentially U-shaped cross section, so that a first U leg, a second U leg and a connecting leg connecting the two U legs with each other are formed, whereby the first shaped part is arranged adjoining the connecting leg. This enables an especially suitable space-saving design.

The first shaped part preferably has a floor area, a first arm section adjoining on one first side of the floor area and a second arm section adjoining on the opposing second side, whereby it is designed so that the first arm section encompasses the free end range of the first U leg. The room specified by the mounting rail elements can hereby be utilized particularly well for the formation of the accommodation space.

The form-closure connection, respectively the lock-in connection is preferably formed between a first edge protruding inwards formed on the first U leg, and a first lock profiling formed on the first arm section on the one hand; and on the other hand, between a second edge protruding inwards formed on the second U leg, and a second lock profiling formed on the second arm section. A particularly suitable stability of the first shaped part can thus be achieved.

The second shaped part preferably has a panel-type area, on which a connecting area adjoins on each of the two sides, whereby the two connecting areas comprise a more elastic material than the panel-type area. A good tightness of the accommodation space and a suitable overall stability of the second shaped part can be achieved here particularly well.

The two connecting areas usually have a V-shaped or a U-shaped cross section in a particularly suitable manner.

The design is preferably such that the two connecting areas, preferably by interconnection of areas of the first shaped part, are arranged pressing against the free end sections of the two U legs. An especially suitable support of the connecting areas and thus of the second shaped part can thus be achieved vis-à-vis the mounting rail elements.

The arrangement is preferably provided in the form of a row lighting system, whereby cables are arranged in the accommodation space, especially for the power supply of a light module of the row lighting system. The row lighting system can hereby be designed especially suitably tight.

BRIEF DESCRIPTION OF THE DRAWINGS

The invention is explained in more detail in the following using an execution example and with reference to the drawings. The following is shown.

DETAILED DESCRIPTION

Figure 1:
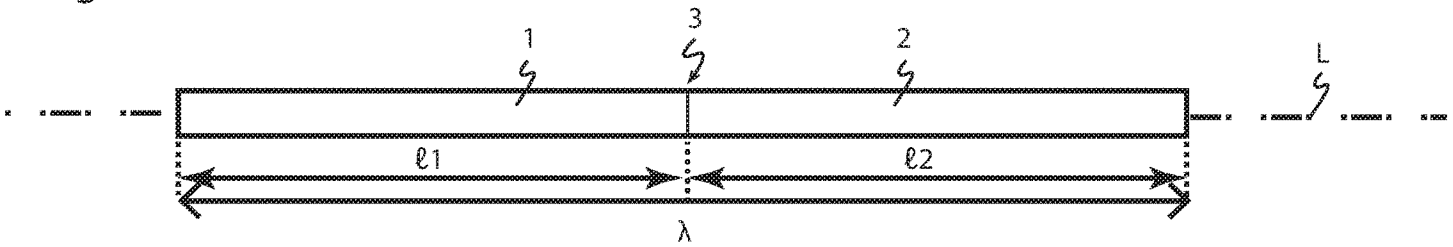
FIG. 1 a drawing of a side view of two mounting rail elements of an arrangement per the invention, FIG. 2 a cross section through the arrangement, and FIG. 3 a sectional longitudinal cut through the arrangement.

The side view of an arrangement per the invention is drawn in FIG. 1. The arrangement is designed to form an elongated channel-type accommodation space. The arrangement can be a row lighting system, in particular.

The arrangement comprises at least two elongated mounting rail elements 1, 2. The mounting rail elements preferably comprise a stable material, such as a metal like aluminum, for example. The guide rail elements 1, 2 can possibly be made from bent sheet metal parts.

Two of the guide rail elements 1, 2 are thereby arranged to abut at their front faces via a joint. If the arrangement comprises more than two mounting rail elements, these mounting rail elements 1,2 are arranged abut according to the arrangement. To simplify the description, the case is considered in the following, in particular, by that the arrangement merely has the two mounting rail elements 1, 2 shown by way of example.

The mounting rail elements 1, 2 are preferably designed as profiled elements, so that they usually extend along a longitudinal axis L. The mounting rail elements 1, 2 preferably have at least essentially a U-shaped cross section, the mounting rail elements 1, 2 of the arrangement have this same cross sectional shape, in particular.

As indicated in FIG. 1, the mounting rail elements 1, 2 are especially arranged in relation to each other so that they form a straight row along the longitudinal axis L.

In the example shown, a first mounting rail element 1 of the at least two mounting rail elements 1, 2 viewed along the longitudinal axis L has a length l1 and a second mounting rail element 2 of the at least two mounting rail elements 1, 2 a length l2, accordingly. It can thereby also be provided that the mounting rail elements 1, 2 of the arrangementusually have the same length or else have different lengths.

The length of the respective mounting rail elements arranged abut by their front faces 1, 2—here described as overall length λ—therefore corresponds to the sums of the lengths l1 and l2 of the individual mounting rails 1, 2.

Furthermore, for the sake of the simpler description, it is assumed here that the mounting rails 1, 2 are arranged open downwards with their U-shaped profile. Another orientation may however generally also be intended across from the verticals.

Figure 2:
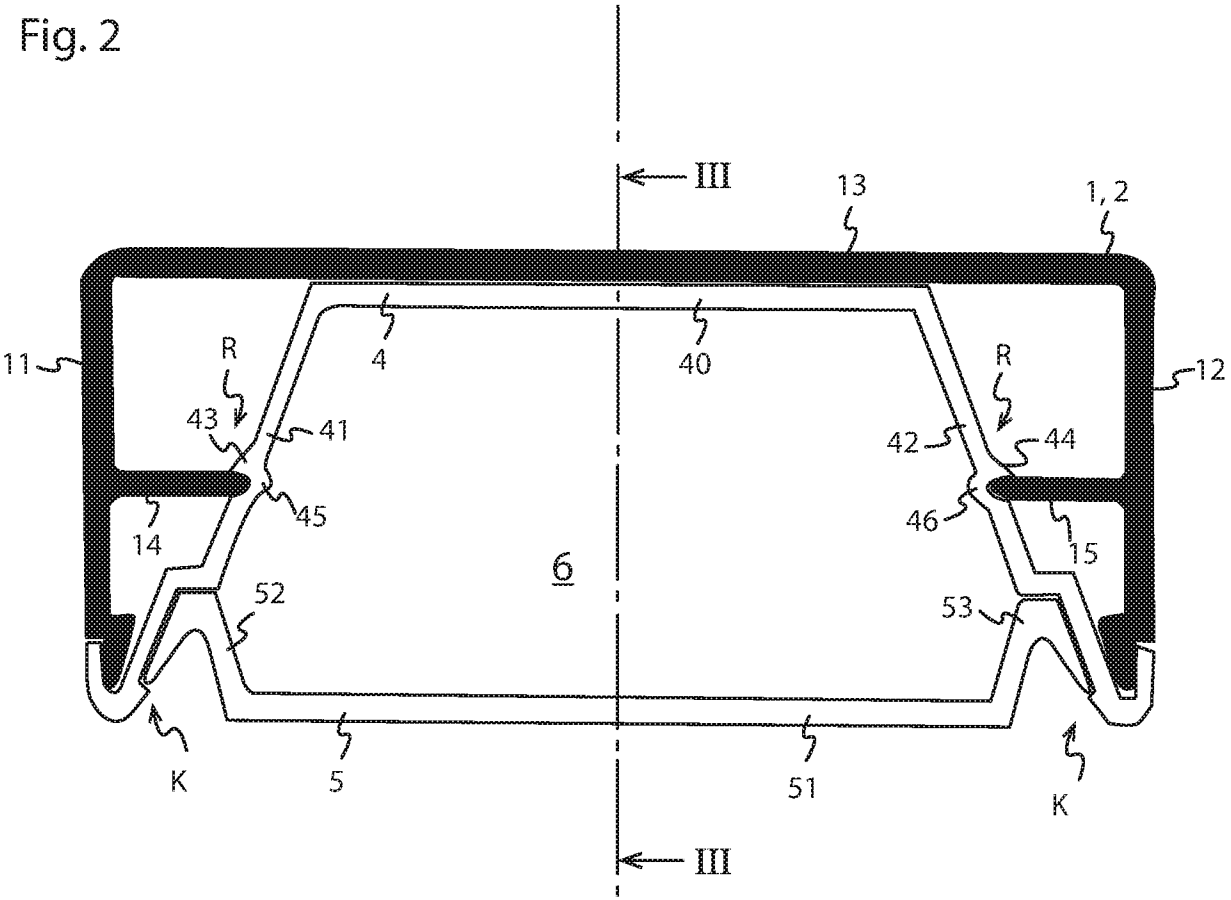

FIG. 2 shows a schematic cross section through the arrangement perpendicular to the longitudinal axis L. The arrangement furthermore has a first shaped part 4 and a second shaped part 5, which is connected with the first shaped part 4 to form the channel-type accommodation space, equipped with the reference sign in this case.

It can especially be intended that the accommodation space 6 is merely formed through the first shaped part 4 and the second shaped part 5. The two shaped parts 4, 5 therefore represent "channel shaped parts". The two shaped parts 4, 5 are arranged in parallel to the longitudinal axis L, respectively are arranged oriented in parallel to the mounting rail elements 1, 2 accordingly.

The accommodation space 6 thereby extends at least substantially over the length of the two mounting rail elements 1, 2, therefore over the entire length λ. It can be intended, for example, that the two shaped parts 4, 5 have a length each that is at least 80% of the overall length λ of the mounting rail elements.

One of the two shaped parts 4,5, the first shaped part in the example shown, is fastened to the mounting rail elements 1, 2.

Using the two shaped parts 4, 5, the mounting rail elements 1, 2 can advantageously be lined, at least mainly through their interior formed through their U-shape, so that the accommodation space 6 viewed across the longitudinal axis L does not have a joint. It can therefore be designed especially suitably tight.

Advantageously, the design is thereby such that the first shaped part 4 is arranged held onto the two mounting rail elements by means of a form-locking connection, especially merely through the form-locking connection. It preferably deals with a lock-in connection R, so that particularly the first shaped part 4 is merely arranged held onto the two mounting rail elements 1,2 through the lock-in connection R. This ensures that the first shaped part 4 can be mounted to the mounting rail elements 1, 2 in an especially suitable way, especially without the use of a tool.

The first shaped part 4 and the second shaped part 5 are preferably directly connected with each other. Such a direct connection is especially suited to achieve a respective tightness.

Provision can especially be made for that the second shaped part 5 is arranged held onto the first shaped part 4 through a clamp connection K, especially merely through the clamp connection K. This ensures that the connection between the two shaped parts 4,5 can be done in an especially simple way, one can thus achieve that the connection can be made without the use of a tool, in particular.

The first shaped part and or the second shaped part are preferably formed from an elastic material at least in part, especially from a more elastic material than the mounting rails 1, 2. This is advantageous with regard to the achieving of a suitable tightness.

The first shaped part 4 and or the second shaped part 5 are furthermore advantageously designed so that they can be wound up in a roll. Both shaped parts 4, 5 are especially designed so that they can usually be wound up in a roll, respectively in a roll, whose diameter is smaller than 2 m. This way, the two shaped parts 4, 5—even if they (in non-rolled-up condition) have great lengths of more than 5 m or more than 10 m, for example, can be transported to an installation site of the arrangement, respectively of the row lighting system in an especially suitable manner.

Through the rollable design of the shaped parts 4,5 one can achieve that the accommodation space 6 can virtually be designed "endlessly".

The first shaped part 4 is preferably arranged in direct contact with the two mounting rail elements 1, 2. A suitable stability of the accommodation space 6 can hereby be effected in a space-saving manner. It can especially be intended that the first shaped part 4 is arranged abut the two mounting rail elements 1, 2.

In the example shown, the mounting rail elements 1, 2 normally have a U-shaped cross-section when viewed towards the longitudinal axis L, as mentioned. This way, a first U leg 11, a second U leg 12, and a connecting leg 13 connecting the two U legs 11, 12 are formed. In the orientation considered here, the connecting leg 13 is at least substantially oriented horizontally, whereby the two U legs 11, 12 extend downward. The first shaped part 4 is thereby advantageously arranged abut the connecting leg 13.

A suitable usage of the interior of the mounting rail elements 1,2 provided by the U-shape can be achieved, if the first shaped part 4 has a floor area 40, a first arm section 41 adjoining to a first side of the floor area 40, and an adjoining second arm section 42 on one of the hereby opposite second side, whereby the design is such that the first arm section 41 encompasses the free end range of the first U leg 11, and the second arm section 42 encompasses the free end range of the second U leg 12. It can hereby be achieved that the accommodation space 6 ends with the clear end ranges, respectively lower edges of the U legs 11, 12, so to speak.

The design is furthermore advantageously space-saving in the shown example, whereas the first shaped part 4 with the floor area 40 is arranged abut the connecting leg 13.

An especially suitable fastening of the first shaped part 4 to the mounting rails 1, 2 can be achieved, when the form-closure connection, respectively the lock-in connection R is preferably formed between a first edge protruding inwards formed on the first U leg, and a first lock profiling formed on the first arm section on the one hand; and on the other hand, between a second edge protruding inwards formed on the second U leg, and a second lock profiling formed on the second arm section. With this design, one can especially achieve that components in the interior of the accommodation space 6 are arranged in such a manner that they support themselves from the inside near the areas opposing the edges 14, 15 protruding inwards. On the respective areas of the arm sections 41, 42 protruding inwards, another profiling 45 can be formed for example. These components can hereby be arranged solidly in the accommodation space in a particularly suitable manner. In case of a row lighting system, these components can be cables, cable trays, light modules, etc., for example.

The lock-in profiles 43, 44 can advantageously be formed at about half the height of the arm sections, 41, 42. As is the case in the example shown, the lower end ranges of the arm sections 41, 42 can be U-shaped so that they hereby encompass the respective lower end range, respectively the lower edge of the respective U-leg, in each case. Two edges can thus be formed towards the lower side, respectively towards the open side of the mounting rail elements 1, 2, which preferably extend throughout the entire length λ.

The arm sections 41, 42 of the first shaped part 4 are thus designed for the fastening of a shaped part 4 to the mounting rail elements 1, 2 and also for the forming of a conclusion of the accommodation space 6, by grasping the lower edge of the U-legs 11, 12 of the mounting rail elements 1, 2.

The second shaped part preferably has a panel-type area 51 that a connecting area 52, 53 adjoins on each of the two sides, whereby the two connecting areas 52, 53 comprise a more elastic material than the panel-type area 51. Through the panel-type area 51—advantageously with regard to the external appearance of the arrangement—a flat, in this case horizontal external area can be formed pointing downwards. The elastic design of the connecting areas 52, 53, can effect a suitable tightness of the accommodation space 6. Preferably, the two connecting areas 53 have a V-shaped or a U-shaped cross section in a particularly suitable manner.

A suitable winding, respectively rolling property of the second shaped part can additionally be achieved advantageously through this design.

The design is furthermore advantageous in that the two connecting area 52, 53 are arranged pressing against the two free end ranges of the two U legs 11, 12. This effects a particularly suitable support of the connecting areas 52, 53. The connecting areas between the two shaped parts 4, 5 can thereby be designed particularly suitably tight—if—as indicated in FIG. 2—the design is such that the connecting areas 52, 53 are arranged pressing against the free end ranges of the two U legs 11, 12 through the interconnection of areas of the first shaped part. As is the case in the shown example, the lower end ranges of the arm sections 41, 42 are designed to enable a clamping of the second shaped part 5, thus establishing the clamp connection K. Respective profiling can hereby be formed—as shown in FIG. 2 by way of example—on the lower end ranges of the arm sections 41, 42.

Figure 3:
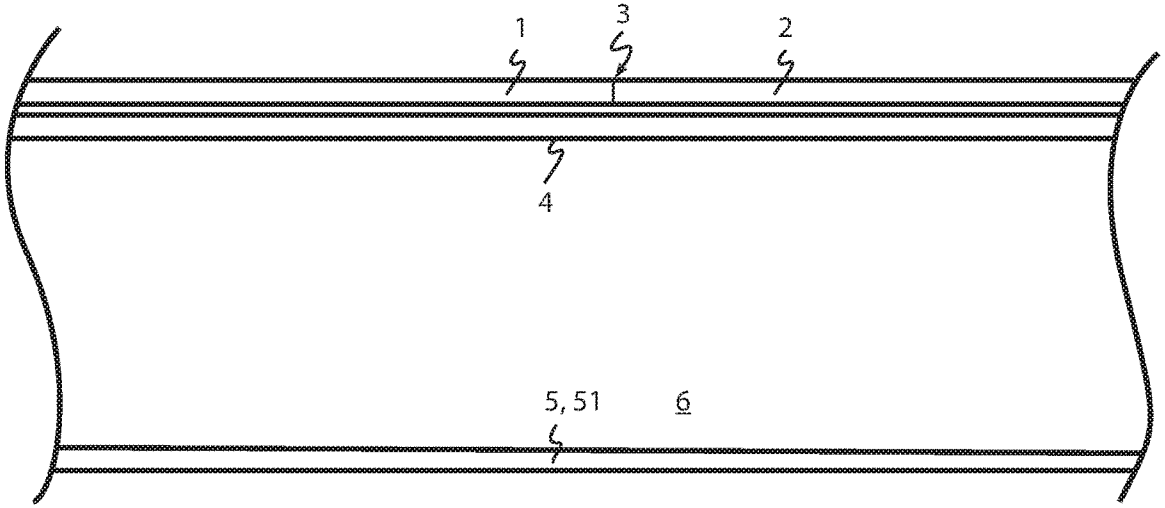

A longitudinal section of the area in FIG. 2 indicated by lll-lll is shown in sections in FIG. 3. One recognizes that the two shaped parts 4, 5 extend over the joint 3, so that a suitable tightness can particularly also be achieved here. It is also evident that the accommodation space 6 has a comparatively large height; it can particularly be intended that the height of the accommodation space 6 essentially extends through the entire height of the mounting rail elements 1, 2. For example, the design can be such that the height of the accommodation space 6 is at least 60%, preferably 80% of the vertical extension of the first U-leg 11.

In the execution example shown, the mounting rails 1, 2 can first be mounted to a ceiling for installation, either directly or suspended. In a second step, the first shaped part 4 can be locked into the mounting rails 1, 2 by producing the lock-in connection R, and in a third step, the second shaped part 5 can be connected with the first shaped part 4 by producing the clamp connection K.

In order to design the accommodation space tight overall, one must then merely just install a suitable seal on the two front faces of the accommodation space 6. Well-known professional measures may be intended for this purpose.

The two shaped parts 4, 5 form a tight form closure throughout their overall length λ. They form a consistent fastening sealing connection throughout their overall length λ. The stability and sustainability is formed through the mounting rail elements 1, 2, the tightness is ensured through the accommodation space 6. Regardless of a great length of the accommodation space 6, an absolute minimization of the tightness situation may be achieved. The shaped parts 4, 5 can reliably be attached in the, respectively on the mounting rail elements 1, 2.

What is claimed is:

1. An arrangement for forming an elongate, channel-type accommodation space, comprising at least two elongate mounting rail elements (1, 2), whereby two of the mounting rail elements (1, 2) abut at their front faces via a joint (3), a first shaped part (4), and a second shaped part (5) connected to the first shaped part (4) to form a channel-type accommodation space (6), which extends at least substantially over the length of the two mounting rail elements (1, 2), whereby one of the shaped parts (4, 5) is fastened to the mounting rail elements;

wherein the mounting rail elements (1, 2) have an at least substantially U-shaped cross-section, so that a first U leg (11), a second U leg (12) and a connecting leg (13) connecting the two U legs (11, 12) with each other are formed, whereby the first shaped part (4) is arranged to abut the connecting leg (13); and further wherein the first shaped part (4) has a floor area (40), a first arm section (41) adjoining on one first side of the floor area (40) and a connecting second arm section (42) adjoining on the opposing second side, whereby it is designed so that the first arm section (41) encompasses the free end range of the first U leg (11), and the second arm section (42) encompasses the free end range of the second U leg (12).

2. The arrangement according to claim 1, wherein the first shaped part (4) and the second shaped part (5) are directly connected with each other.

3. The arrangement according to claim 1, wherein the first shaped part (4) or the second shaped part (5) are comprised of an elastic material.

4. The arrangement according to claim 1, wherein the first shaped part (4) is arranged in direct contact with the two mounting rail elements (1, 2).

5. The arrangement according to claim 1, wherein the second shaped part (5) has a panel-type area (51) that a connecting area (52, 53) adjoins on each of the two sides, whereby the two connecting areas (52, 53) comprise a more elastic material than the panel-type area (51).

6. The arrangement according to claim 5, wherein the two connecting areas (52, 53) comprise a V-shaped or a U-shaped cross-section.

7. A row lighting system comprising the arrangement according to claim 1.

8. An arrangement for forming an elongate, channel-type accommodation space, comprising at least two elongate mounting rail elements (1, 2), whereby two of the mounting rail elements (1, 2) abut at their front faces via a joint (3), a first shaped part (4), and a second shaped part (5) connected to the first shaped part (4) to form a channel-type accommodation space (6), which extends at least substantially over the length of the two mounting rail elements (1, 2), whereby one of the shaped parts (4, 5) is fastened to the mounting rail elements;

wherein the first shaped part (4) is arranged held onto the two mounting rail elements (1, 2) through a form-locking connection, wherein the first shaped part (4) has a floor area (40), a first arm section (41) adjoining on one first side of the floor area (40) and a connecting second arm section (42) adjoining on the opposing second side, whereby it is designed so that the first arm section (41) encompasses the free end range of the first U leg (11), and the second arm section (42) encompasses the free end range of the second U leg (12), and wherein the form-locking connection is formed between a first edge (14) protruding inwards formed on the first U leg (11), and a first lock profiling (43) formed on the first arm section on the one hand; and on the other hand, between a second edge (15) protruding inwards formed on the second U leg (12), and a second lock profiling (44) formed on the second arm section (42).

9. The arrangement according to claim 1, wherein the first shaped part (4) and the second shaped part (5) are directly connected with each other.

10. The arrangement according to claim 1, wherein the first shaped part (4) or the second shaped part (5) are comprised of an elastic material.

11. The arrangement according to claim 10, wherein the first shaped part (4) or the second shaped part (5) are designed so that they can be wound up in a roll.

12. The arrangement according to claim 1, wherein the first shaped part (4) is arranged in direct contact with the two mounting rail elements (1, 2).

13. The arrangement according to claim 1, wherein the first shaped part (4) is arranged flat abut the two mounting rail elements (1, 2).

14. The arrangement according to claim 1, wherein the second profile part (5) is arranged held onto the first shaped part (4) through a clamp connection (K).

15. The arrangement according to claim 1, wherein the second shaped part (5) has a panel-type area (51) that a connecting area (52, 53) adjoins on each of the two sides, whereby the two connecting areas (52, 53) comprise a more elastic material than the panel-type area (51).

16. The arrangement according to claim 15, wherein the two connecting areas (52, 53) comprise a V-shaped or a U-shaped cross-section.

17. The arrangement according to claim 1, wherein the mounting rail elements (1, 2) have an at least substantially U-shaped cross-section, so that a first U leg (11), a second U leg (12) and a connecting leg (13) connecting the two U legs (11, 12) with each other are formed, whereby the first shaped part (4) is arranged to abut the connecting leg (13), wherein the second shaped part (5) has a panel-type area (51) that a connecting area (52, 53) adjoins on each of the two sides, whereby the two connecting areas (52, 53) comprise a more elastic material than the panel-type area (51), and wherein the design is such that the two connecting areas (52, 53) are arranged pressing against the free end ranges of the two U legs (11, 12) through the interconnection of areas of the first profile part (4).

18. A row lighting system comprising the arrangement according to claim 1.

* * * * *